US008661980B1

(12) United States Patent
Roemerman et al.

(10) Patent No.: US 8,661,980 B1
(45) Date of Patent: Mar. 4, 2014

(54) WEAPON AND WEAPON SYSTEM EMPLOYING THE SAME

(75) Inventors: Steven D. Roemerman, Highland Village, TX (US); Joseph Edward Tepera, Muenster, TX (US)

(73) Assignee: Lone Star IP Holdings, LP, Addison, TX (US)

( * ) Notice: Subject to any disclaimer, the term of this patent is extended or adjusted under 35 U.S.C. 154(b) by 318 days.

(21) Appl. No.: 10/841,192

(22) Filed: May 7, 2004

Related U.S. Application Data

(60) Provisional application No. 60/468,906, filed on May 8, 2003.

(51) Int. Cl.
*F42B 12/58* (2006.01)
*F42B 12/62* (2006.01)

(52) U.S. Cl.
USPC ..... 102/489

(58) Field of Classification Search
USPC ..... 102/382, 383, 384, 389, 393, 394, 438, 102/473, 474, 480, 489
See application file for complete search history.

(56) References Cited

U.S. PATENT DOCUMENTS

| | | | | |
|---|---|---|---|---|
| 1,039,850 | A | | 10/1912 | Volter |
| 1,077,989 | A | | 11/1913 | Maxim |
| 1,240,217 | A | | 9/1917 | Ingram |
| 1,550,622 | A | | 8/1925 | Lesh |
| 1,582,495 | A | | 11/1925 | Dalton |
| 2,295,442 | A | | 9/1942 | Wilhelm |
| 2,350,140 | A | | 5/1944 | Wilton |
| 2,397,088 | A | | 3/1946 | Clay |
| 1,312,764 | A | | 7/1948 | Straub |
| 2,445,311 | A | | 7/1948 | Cooke et al. |
| 2,621,732 | A | * | 12/1952 | Ahlgren ..... 175/4.55 |
| 2,767,656 | A | * | 10/1956 | Zeamer ..... 102/438 |
| 2,809,583 | A | | 10/1957 | Ortynsky et al. |
| 2,852,981 | A | | 9/1958 | Caya |
| 2,911,914 | A | | 11/1959 | Wynn et al. |
| 2,934,286 | A | | 4/1960 | Kiernan |
| 2,958,260 | A | | 11/1960 | Anderson |
| 3,211,057 | A | | 10/1965 | White, Jr. et al. |
| 3,242,861 | A | | 3/1966 | Reed, Jr. |
| 3,332,348 | A | | 7/1967 | Myers et al. |
| 3,377,952 | A | | 4/1968 | Crockett |
| 3,379,131 | A | | 4/1968 | Webb |
| 3,429,262 | A | * | 2/1969 | Kincheloe et al. ..... 102/438 |

(Continued)

FOREIGN PATENT DOCUMENTS

EP 0298494 * 1/1989

OTHER PUBLICATIONS

Andersson, O., et al., "High Velocity Jacketed Long Rod Projectiles Hitting Oblique Steel Plates," 19th Inteational Symposium of Ballistics, May 7-11, 2001, pp. 1241-1247, Interlaken, Switzerland.

(Continued)

*Primary Examiner* — David Parsley
(74) *Attorney, Agent, or Firm* — Boisbrun Hofman, PLLC

(57) ABSTRACT

A weapon and weapon system, and methods of manufacturing and operating the same. In one embodiment, the weapon includes a warhead having an outer casing that forms an internal chamber and a dart within the internal chamber. The dart includes a main body formed with a non-explosive material and is configured to exit the internal chamber via an opening therein.

20 Claims, 9 Drawing Sheets

(56) References Cited

U.S. PATENT DOCUMENTS

| | | | | | |
|---|---|---|---|---|---|
| 3,545,383 | A | | 12/1970 | Lucy | |
| 3,555,826 | A | | 1/1971 | Bennett | |
| 3,625,106 | A | | 12/1971 | Russo et al. | |
| 3,625,152 | A | | 12/1971 | Schneider et al. | |
| 3,667,342 | A | | 6/1972 | Warnock et al. | |
| 3,703,844 | A | | 11/1972 | Bleikamp, Jr. | |
| 3,759,466 | A | | 9/1973 | Evers-Euterneck | |
| 3,763,786 | A | * | 10/1973 | MacDonald | 102/512 |
| 3,771,455 | A | * | 11/1973 | Haas | 102/377 |
| 3,789,337 | A | | 1/1974 | Sheppard | |
| 3,820,106 | A | | 6/1974 | Yamashita et al. | |
| 3,872,770 | A | | 3/1975 | McGuire | |
| 3,887,991 | A | | 6/1975 | Panella | |
| 3,941,059 | A | * | 3/1976 | Cobb | 102/510 |
| 3,943,854 | A | | 3/1976 | Zwicker | |
| 3,954,060 | A | * | 5/1976 | Haag et al. | 102/494 |
| 3,956,990 | A | | 5/1976 | Rowe | |
| 3,995,792 | A | | 12/1976 | Otto et al. | |
| 3,998,124 | A | | 12/1976 | Milhous et al. | |
| 4,015,527 | A | * | 4/1977 | Evans | 102/433 |
| 4,036,140 | A | * | 7/1977 | Korr et al. | 102/438 |
| 4,091,734 | A | | 5/1978 | Redmond et al. | |
| 4,172,407 | A | | 10/1979 | Wentink | |
| 4,211,169 | A | * | 7/1980 | Brothers | 102/494 |
| 4,364,531 | A | | 12/1982 | Knoski | |
| 4,383,661 | A | | 5/1983 | Ottenheimer et al. | |
| 4,430,941 | A | * | 2/1984 | Raech et al. | 102/496 |
| 4,478,127 | A | | 10/1984 | Hennings et al. | |
| 4,522,356 | A | | 6/1985 | Lair et al. | |
| 4,616,554 | A | | 10/1986 | Spink et al. | |
| 4,625,646 | A | | 12/1986 | Pinson | |
| 4,648,324 | A | | 3/1987 | McDermott | |
| 4,709,877 | A | | 12/1987 | Goulding | |
| 4,714,020 | A | | 12/1987 | Hertsgaard et al. | |
| 4,744,301 | A | | 5/1988 | Cardoen | |
| 4,750,404 | A | | 6/1988 | Dale | |
| 4,750,423 | A | | 6/1988 | Nagabhushan | |
| 4,756,227 | A | | 7/1988 | Ash et al. | |
| 4,770,101 | A | * | 9/1988 | Robertson et al. | 102/489 |
| 4,775,432 | A | | 10/1988 | Kolonko et al. | |
| 4,777,882 | A | | 10/1988 | Dieval | |
| 4,803,928 | A | | 2/1989 | Kramer et al. | |
| 4,842,218 | A | | 6/1989 | Groutage et al. | |
| 4,860,969 | A | | 8/1989 | Muller et al. | |
| 4,870,885 | A | | 10/1989 | Grosselin et al. | |
| 4,882,970 | A | | 11/1989 | Kovar | |
| 4,922,799 | A | | 5/1990 | Bartl et al. | |
| 4,922,826 | A | * | 5/1990 | Busch et al. | 102/489 |
| 4,932,326 | A | | 6/1990 | Ladriere | |
| 4,934,269 | A | | 6/1990 | Powell | |
| 4,957,046 | A | | 9/1990 | Puttock | |
| 4,996,923 | A | * | 3/1991 | Theising | 102/438 |
| 5,056,408 | A | | 10/1991 | Joner et al. | |
| 5,107,766 | A | | 4/1992 | Schliesske et al. | |
| 5,132,843 | A | | 7/1992 | Aoyama et al. | |
| 5,231,928 | A | | 8/1993 | Phillips et al. | |
| 5,311,820 | A | | 5/1994 | Ellingsen | |
| 5,325,786 | A | * | 7/1994 | Petrovich | 102/438 |
| 5,348,596 | A | | 9/1994 | Goleniewski et al. | |
| 5,413,048 | A | | 5/1995 | Werner et al. | |
| 5,440,994 | A | * | 8/1995 | Alexander | 102/439 |
| 5,451,014 | A | | 9/1995 | Dare et al. | |
| 5,467,940 | A | | 11/1995 | Steuer | |
| 5,529,262 | A | | 6/1996 | Horwath | |
| 5,541,603 | A | | 7/1996 | Read et al. | |
| 5,546,358 | A | * | 8/1996 | Thomson | 367/128 |
| 5,561,261 | A | | 10/1996 | Lindstadt et al. | |
| 5,567,912 | A | | 10/1996 | Manning et al. | |
| 5,681,008 | A | | 10/1997 | Kinstler | |
| 5,698,815 | A | | 12/1997 | Ragner | |
| 5,728,968 | A | | 3/1998 | Buzzett et al. | |
| 5,796,031 | A | * | 8/1998 | Sigler | 102/520 |
| 5,816,532 | A | | 10/1998 | Zasadny et al. | |
| 5,834,684 | A | | 11/1998 | Taylor | |
| 5,969,864 | A | | 10/1999 | Chen et al. | |
| 5,978,139 | A | | 11/1999 | Hatakoshi et al. | |
| 5,988,071 | A | | 11/1999 | Taylor | |
| 6,019,317 | A | | 2/2000 | Simmons et al. | |
| 6,021,716 | A | | 2/2000 | Taylor | |
| 6,105,505 | A | | 8/2000 | Jones | |
| 6,174,494 | B1 | | 1/2001 | Lowden et al. | |
| 6,216,595 | B1 | | 4/2001 | Lamorlette et al. | |
| 6,253,679 | B1 | | 7/2001 | Woodall et al. | |
| 6,293,202 | B1 | | 9/2001 | Woodall et al. | |
| 6,324,985 | B1 | | 12/2001 | Petrusha | |
| 6,338,242 | B1 | | 1/2002 | Kim et al. | |
| 6,374,744 | B1 | | 4/2002 | Schmacker et al. | |
| 6,389,977 | B1 | | 5/2002 | Schmacker et al. | |
| 6,523,477 | B1 | | 2/2003 | Brooks et al. | |
| 6,523,478 | B1 | | 2/2003 | Gonzalez et al. | |
| 6,540,175 | B1 | | 4/2003 | Mayersak et al. | |
| 6,615,116 | B2 | | 9/2003 | Ebert et al. | |
| 6,666,123 | B1 | | 12/2003 | Adams et al. | |
| 6,705,571 | B2 | | 3/2004 | Shay et al. | |
| 6,832,740 | B1 | * | 12/2004 | Ransom | 244/3.13 |
| 6,834,835 | B1 | | 12/2004 | Knowles et al. | |
| 6,871,817 | B1 | | 3/2005 | Knapp | |
| 7,019,650 | B2 | | 3/2006 | Volpi et al. | |
| 7,143,698 | B2 | | 12/2006 | Lloyd | |
| 7,156,347 | B2 | | 1/2007 | Lam et al. | |
| 7,221,847 | B2 | | 5/2007 | Gardiner et al. | |
| 7,340,986 | B1 | | 3/2008 | Gaigler | |
| 7,530,315 | B2 | | 5/2009 | Tepera et al. | |
| 7,690,304 | B2 | | 4/2010 | Roemerman et al. | |
| 7,895,946 | B2 | | 3/2011 | Roemerman et al. | |
| 8,042,471 | B2 | | 10/2011 | Michel et al. | |
| 2003/0051629 | A1 | * | 3/2003 | Zavitsanos et al. | 102/510 |
| 2003/0123159 | A1 | | 7/2003 | Morita et al. | |
| 2003/0192992 | A1 | | 10/2003 | Olsen et al. | |
| 2004/0174261 | A1 | | 9/2004 | Volpi et al. | |
| 2005/0127242 | A1 | | 6/2005 | Rivers, Jr. | |
| 2005/0180337 | A1 | | 8/2005 | Roemerman et al. | |
| 2005/0201450 | A1 | | 9/2005 | Volpi et al. | |
| 2006/0017545 | A1 | | 1/2006 | Volpi et al. | |
| 2006/0077036 | A1 | | 4/2006 | Roemerman et al. | |
| 2006/0198033 | A1 | | 9/2006 | Soyama et al. | |
| 2007/0035383 | A1 | | 2/2007 | Roemerman et al. | |
| 2010/0031841 | A1 | | 2/2010 | Michel et al. | |
| 2010/0326264 | A1 | | 12/2010 | Roemerman et al. | |
| 2011/0108660 | A1 | | 5/2011 | Roemerman et al. | |
| 2011/0179963 | A1 | | 7/2011 | Tepera et al. | |

OTHER PUBLICATIONS

Davitt, R.P., "A Comparison of the Advantages and Disadvantages of Depleted Uranium and Tungsten Alloy as Penetrator Materials," Tank Ammo Section Report No. 107, Jun. 1980, 32 pages, U.S. Army Armament Research and Development Command, Dover, NJ.

"DOE Handbook: Primer on Spontaneous Heating and Pyrophoricity," Dec. 1994, 87 pages, DOE-HDBK-1081-94, FSC-6910, U.S. Department of Energy, Washington, D.C.

Rabkin, N.J., et al., "Operation Desert Storm: Casualties Caused by Improper Handling of Unexploded U.S. Submunitions," GAO Report to Congressional Requestors, Aug. 1993, 24 pages, GAO/NSIAD-93-212, United States General Accounting Office, Washington, D.C.

"UNICEF What's New?: Highlight: Unexploded Ordnance (UXO)," http://www.unicef.org.vn/uxo.htm, downloaded Mar. 8, 2005, 3 pages.

Smart, M.C., et al., "Performance Characteristics of Lithium Ion Cells at Low Temperatures," IEEE AESS Systems Magazine, Dec. 2002, pp. 16-20, IEEE, Los Alamitos, CA.

* cited by examiner

WEAPON AND WEAPON SYSTEM EMPLOYING THE SAME

CROSS REFERENCE TO RELATED APPLICATIONS

This application claims the benefit of U.S. Provisional Application No. 60/468,906, filed on May 8, 2003, entitled "Weapon System, Warhead and Weapons Design for Increased Mission Effectiveness and Decreased Collateral Damage," which application is incorporated herein by reference.

TECHNICAL FIELD

The present invention is directed, in general, to weapon systems and, more specifically, to a weapon and weapon system, and methods of manufacturing and operating the same.

BACKGROUND

Recent improvements in weapon guidance technology employed to guide weapons on to an intended target and the resulting gains in weapon delivery accuracy combined with an improved knowledge of a location of the target have provided the ability to achieve reliable weapon impact on a selected target with zero or nearly zero circular error of probability. The impact of a weapon directed by guidance systems on the selected target is highly accurate within a very high measure of probability. Discrete targets, that is targets encompassing small areas such as a single vehicle, a bunker, a building, a petroleum storage tank within a petroleum farm, and other like objects, are readily struck with guided weapons.

Unitary warheads employed in weapons, currently in military inventory to attack targets such as discrete targets, contain a large amount of chemically based explosives. Explosives or an explosive material generally refers to a material capable of generating a violent chemical reaction of short duration that induces a substantial pressure wave. The detonation and the associated high temperature, pressure shock wave, fragments, and shrapnel generated is nominally more than sufficient to cause extensive damage to the selected target. In addition to the selected target, however, the unitary warheads often damage other objects, features, and people not associated with the target and beyond its physical limits thereby introducing the almost certain potential of collateral damage. Collateral damage refers to items, features and people not associated with the target that are not intended to be injured or destroyed by the weapon.

Another source of potential collateral damage is the need to attack targets repeatedly, especially if battle damage assessments (or "bomb damage assessments") are ambiguous. With each attack, the probability of collateral damage increases. Thus, the ability to plan and assess attacks is another element of addressing the undesired results of such attacks.

In a like manner, improvements in weapon guidance technology have provided the ability to accurately guide weapons to targets encompassing an extended area. Weapons carrying a multitude of bomblets, often referred to as submunitions such as combined effects bomblets, can achieve nearly uniform and significantly dense, overlapping patterns over the intended target area. Submunitions provide a degree of penetration capability, and induce blast, fragmentation and incendiary reactions to damage or destroy the intended target. Recent surveys of post operations battlegrounds and training sites, however, have revealed that on the order of five percent to 23 percent of the dispensed submunitions failed to detonate (see, for instance, "Operation Desert Storm: Casualties Caused by Improper Handling of Unexploded U.S. Submunitions," by Government Accounting Office Report NISAD-93-212, August 1993, which is incorporated herein by reference).

Each unexploded submunition is a latent and potentially lethal hazard to people and livestock in the area, as well as to explosive ordnance disposal operations and other activities that may cause contact with or motion of an unexploded submunition. The unexploded submunition and, more generally, unexploded ordnance is a serious problem and requires skilled personnel who are trained and equipped at great expense to find, identify, and disable such items. The political implications and efforts to locate, avoid, and dispose of unexploded ordnance, and the associated latent lethal effects of these items before they are dealt with, are of such magnitude that cluster submunitions are now being viewed with disdain similar to that of land mines. As a result, a number of countries are moving to ban dispensed munitions, combined effect bomblets and other similar submunitions from their weapons inventory.

While the energetic nature of chemical explosives, sensitivity of fuzes, and the warhead incorporating these elements, when properly excited, produces the desired destructive force, these same elements, when inadvertently and unintentionally exposed to stressing environments, can also produce the same or similar destructive forces with disastrous consequences. As an example, in World War II and the Viet Nam war, United States Navy aircraft carriers, embarked aircraft and shipboard personnel experienced extensive damage, destruction, injury, and death when ready weapons went high order during unintended events. Ready weapons are those weapons that have been removed from the protective magazines and storage bunkers and are at a state of near immediate use. Thus, ready weapons are less protected from stressing environments (e.g., hot exhaust from aircraft engines, stray electromagnetic stimulation, enemy action and other similar events) that can induce an inadvertent high order detonation providing the full or nearly full destructive force of the warhead. The volatile nature of the warhead is of extreme concern to the operating forces. Extensive research, strict design criteria, and ancillary requirements at increased cost and complexity of the life cycle design of the weapon has reduced this threat somewhat. Significant opportunities for undesirable events such as recounted herein still remain.

Many references in the past have attempted to address the safety issues associated with weapons including the types of material employed therewith. For a better understanding of exemplary weapons, peripherals and materials that address such issues, see the following references, namely, U.S. Pat. No. 3,625,152 entitled "Impact-Actuated Projectile Fuze," to Schneider, et al, issued Dec. 7, 1971, U.S. Pat. No. 3,887,991 entitled "Method of Assembling a Safety Device for Rockets," to Panella, issued Jun. 10, 1975, U.S. Pat. No. 4,775,432 entitled "High Molecular Weight Polycaprolactone Prepolymers Used in High-energy Formulations," Kolonko, et al., issued Oct. 4, 1988, U.S. Pat. No. 5,311,820 entitled "Method and Apparatus for Providing an Insensitive Munition," Ellingsen, issued May 17, 1994, U.S. Pat. No. 5,348,596 entitled "Solid Propellant with non Crystalline Polyether/inert Plasticizer Binder," to Goleniewski, et al., issued Sep. 20, 1994, U.S. Pat. No. 5,567,912 entitled "Insensitive Energetic Compositions, and Related Articles and Systems and Processes," to Manning, et al., issued Oct. 22, 1996, U.S. Pat. No. 6,253,679 entitled "Magneto-inductive On-command Fuze and Firing Device," to Woodall, et al, issued Jul. 3, 2001, U.S. Pat. No. 6,338,242 entitled "Vented Mk 66 Rocket Motor Tube with a Thermoplastic Warhead Adapter," to Kim, et al., issued Jan. 15, 2002, which are incorporated herein by reference. While the aforementioned references, and others for that matter, attempt to address specific problems associated with weapon unintended consequences, continued study and improvement is necessary to reduce unintended events and consequences associated with the use of weapons and weapon systems.

Accordingly, what is needed in the art is an effective weapon and warhead that is adequate for the mission and very limited and specific to its area of intended destruction. The destructive force of the warhead should be confined to the intended target without inflicting damage to adjacent and non targeted structures, features, and innocent personnel. Additionally, the warhead should be substantially insensitive to stressing environments to significantly reduce the exposure to inadvertent explosion.

SUMMARY

These and other problems are generally solved or circumvented, and technical advantages are generally achieved, by advantageous embodiments of the present invention which includes a weapon and weapon system, and methods of manufacturing and operating the same. In one embodiment, the weapon includes a warhead having an outer casing that forms an internal chamber and a dart within the internal chamber. The dart includes a main body formed with a non-explosive material and is configured to exit the internal chamber via an opening therein.

In a related, but alternative embodiment, the present invention provides a weapon system including, in one embodiment, a delivery vehicle and a weapon couplable to the delivery vehicle. The weapon includes a warhead having an outer casing that forms an internal chamber and a dart within the internal chamber. The dart includes a main body formed with a non-explosive material and is configured to exit the internal chamber via an opening therein. The weapon also includes a guidance system configured to direct the weapon to a target.

In another aspect, the present invention provides a weapon that incorporates a submunition therein. In one embodiment, the weapon includes a warhead having an outer casing that forms an internal chamber and a submunition within the internal chamber. The submunition is configured to exit the internal chamber via an opening therein. The weapon also includes a dart within the submunition and including a main body formed with a non-explosive material.

In a related, but alternative embodiment, the present invention provides a weapon system including a delivery vehicle and a weapon couplable to the delivery vehicle. The weapon includes a warhead having an outer casing that forms an internal chamber and a submunition within the internal chamber. The submunition is configured to exit the internal chamber via an opening therein. The weapon also includes a dart within the submunition and including a main body formed with a non-explosive material. The weapon still further includes a guidance system configured to direct the weapon to a target.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, namely, a weapon and weapon system that increases mission effectiveness and decreases collateral damage. The weapon includes a warhead with at least one dart therein. The dart is formed from a non-explosive material to, among other things, reduce the amount of collateral damage associated with deploying the weapon.

Figure 1:
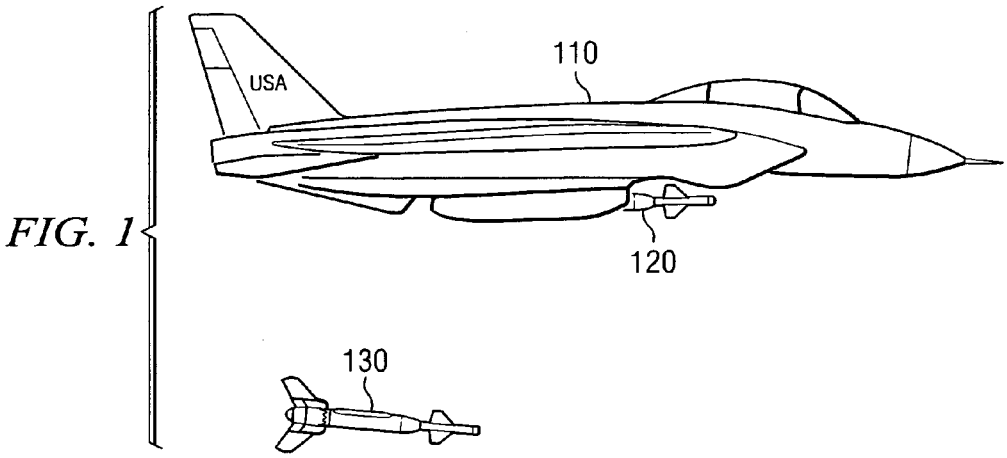
FIG. 1 illustrates a view of an embodiment of a weapon system in accordance with the principles of the present invention.

Referring initially to FIG. 1, illustrated is a view of an embodiment of a weapon system in accordance with the principles of the present invention. The weapon system includes a delivery vehicle (e.g., an airplane such as a F-14) 110 and at least one weapon. As demonstrated, a first weapon 120 is attached to the delivery vehicle and a second weapon 130 is deployed from the delivery vehicle 110 intended for a target.

The weapon system is configured to provide total energy as derived, without limitation, from a velocity and altitude of the delivery vehicle 110 in the form of kinetic energy and potential energy to the first and second weapons 120, 130 and, ultimately, the warhead, submunitions and darts therein. The first and second weapons 120, 130 when released from the delivery vehicle 110 provide guided motion for the warhead, submunitions and darts to the target. The total energy transferred from the delivery vehicle 110 as well as any additional energy acquired through the first and second weapons 120, 130 through propulsion, gravity or other parameters provides the kinetic energy to the warhead to perform the intended mission. While the first and second weapons 120, 130 described with respect to FIG. 1 represent precision guided weapons, those skilled in the art understand that the principles of the present invention also apply to other types of weapons including weapons that are not guided by guidance technology or systems.

In general, it should be understood that other delivery vehicles including other aircraft may be employed such that the weapons contain significant total energy represented as kinetic energy plus potential energy. Kinetic energy is equal to "$\frac{1}{2}mv^2$" where "m" is the mass of the weapon and "v" is the velocity of the weapon, and potential energy is equal to "mgh" where "m" is the mass of the weapon, "g" is gravitational acceleration equal to 9.8 $M/sec^2$, and "h" is the height of the weapon at its highest point with respect to the height of the target. Thus, at the time of impact, all the energy of the weapon is kinetic energy, which is directed into and towards the destruction of the target with little to no collateral damage of surroundings. This is due to the absence of an explosive charge which destroys a target by significant over pressure and high temperature due to the explosive effects of the warhead. Unfortunately, this also causes considerable damage to surroundings as well.

Figure 2:
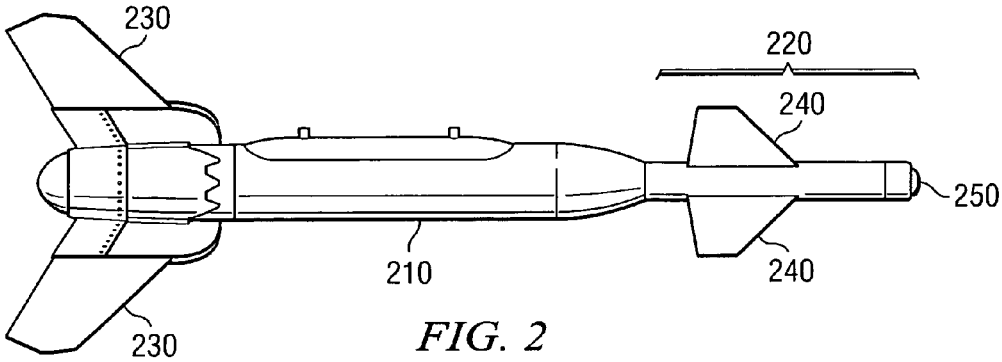
FIG. 2 illustrates a side view of an embodiment of a weapon constructed according to the principles of the present invention.

Turning now FIG. 2, illustrated is a side view of an embodiment of a weapon constructed according to the principles of the present invention. The weapon includes a warhead 210 with an internal chamber and at least one dart (see FIGUREs described below) within the internal chamber. The weapon also includes a guidance system 220 and a plurality of tail fins 230.

The guidance system 220 includes control surfaces 240 and a laser seeker 250. The laser seeker 250 detects the reflected energy from a selected target which is being illuminated by a laser. The laser seeker 250 provides signals so as to drive the control surfaces 240 in a manner such that the weapon is directed to the target. The tail fins 230 provide both stability and lift to the weapon. Modern precision guided weapons such as guided bomb units (e.g., GBU-24) can be very precisely guided to a specific target so that the considerable explosive energy such as with combined effects bomblets is often not needed to destroy an intended target. In many instances, the kinetic energy discussed above is more than sufficient to destroy a target, especially when the weapon can be directed with sufficient accuracy to strike a specific designated target.

Additionally, the warhead 210 employable with the weapon may be of a unitary configuration including at least one dart. The dart may be contained within the unitary warhead by intermediate packaging, mechanical features, electromagnetic devices, fasteners, explosive bolts or other like construction techniques. In another embodiment, the warhead employable with the weapon 120 may include submunitions including at least one dart. The darts may be contained within the submunitions by intermediate packaging, mechanical features, electromagnetic devices, fasteners, explosive bolts or other like construction techniques.

As herein described, the term "dart" generally refers to a device having the properties of a large mass-to-cross sectional area (frontal area) ratio and a small diameter-to-length ratio with a fore end thereof that may be shaped to affect aerodynamic efficiency and penetration. The dart may include at least one tail fin at an aft end to affect the aerodynamics of the dart. The dart is generally constructed of materials selected to achieve penetration, fragmentation, or incendiary effects. The darts may be of substantially different weights, dimensions, materials, shapes, and geometries. Additionally, in warheads employing a plurality of darts, a design and construction of each dart (or ones thereof) may be different.

Figure 3A:
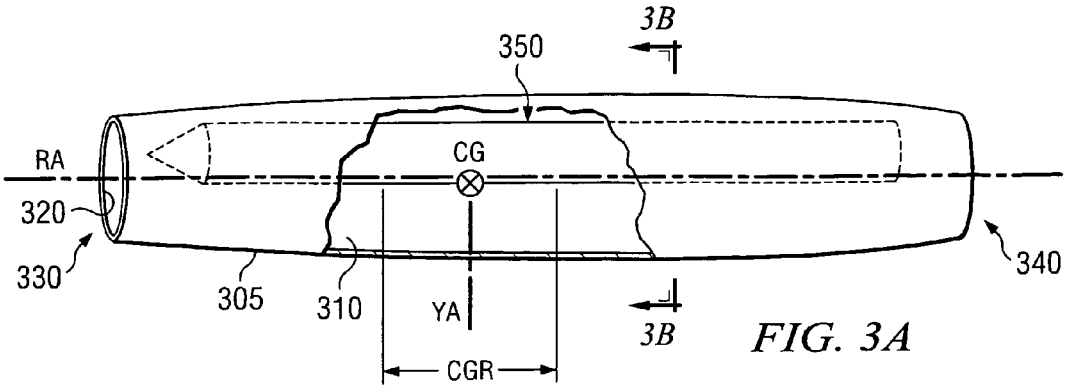
FIGS. 3A and 3B illustrate views of an embodiment of a warhead constructed according to the principles of the present invention.
Figure 3B:
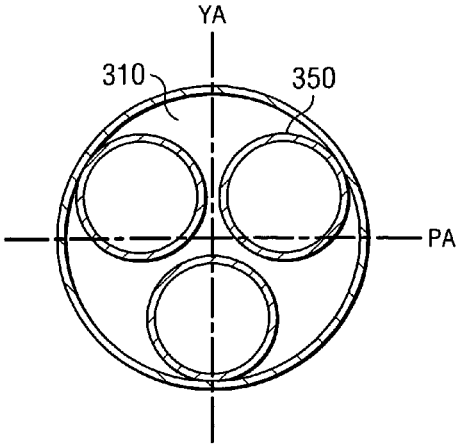

Turning now to FIGS. 3A and 3B, illustrated are views of an embodiment of a warhead constructed according to the principles of the present invention. More specifically, FIG. 3A illustrates a side view of the warhead and FIG. 3B illustrates a cross sectional view of the warhead. The warhead includes an outer casing 305 that forms an internal chamber 310 and conforms to a unitary construction in compliance with a well known configuration such as a Mark ("MK")-82. The warhead and the internal chamber 310 have openings (generally designated 320) at a fore end 330 and aft end 340 thereof. The internal chamber 310 of the warhead creates a generally cylindrical volume and contains at least one dart (one of which is illustrated in FIG. 3A and a plurality of which are illustrated in FIG. 3B; generally designated 350). Within the description of the FIGUREs that follow, three darts 350 are often used for ease of illustration. In all cases, however, multiple darts or a single dart may be employed consistent with the principles of the present invention. As illustrated, the warhead demonstrates a generally aerodynamic geometry with a center of gravity CG, a center of gravity range CGR, a roll axis RA and yaw axis YA. In addition to a plurality of darts 350, FIG. 3B illustrates a pitch axis PA and the yaw axis YA.

Efficient configuration management substantially reduces the effort and cost of qualifying a weapon for carriage on an aircraft or for application in an existing weapon delivery system and, for these reasons, close similarity of the weapon and warhead to an existing, qualified weapon configuration is desirable. Some of the more important parameters to manage are the weight, center of gravity CG, principle mass moments of inertia and the aerodynamic geometry of the weapon and warhead. Tight regulations over the geometric configurations to conform with an existing, qualified configuration enhances the physical attachment of the weapon with the weapon delivery system including the delivery vehicle. Those skilled in the art will recognize that other parameters may be addressed to improve performance characteristics of the weapon and the management thereof. This is of particular importance for carriage on the wing stations of fixed wing aircraft and the separation of the weapons from within the confines of an aircraft's internal weapons bay. In addition, close similarity of these parameters with existing guided weapons can reduce the need to modify guidance systems including software and control devices required to properly guide the weapons after release. A number of safety issues, familiar to those skilled in the art, are influenced by the forces, which impinge on the wing station because of the weapon's inertia.

Several techniques may be used to address the weight, center of gravity CG, and principle moments of inertia of a warhead. First, begin with the nominal characteristics of the geometrical configuration of the warhead such as the MK-82. The characteristics include the aerodynamic constitution, the weight, center of gravity CG, center of gravity range CGR and the mass moments of inertia about the roll axis RA, the pitch axis PA and the yaw axis YA of the warhead. Second, observe the degree of permitted variation. In the case of most weapons, a wide degree of variation is permitted to reduce manufacturing costs. Third, generally observe that more mass is concentrated toward the fore end of the weapon or warhead for the following reasons. For aerodynamics, it is generally preferable to have the center of gravity CG forward of the center of pressure. For target effects, an outer casing of the weapon should not fail until a fuze has functioned allowing more structure and strength forward. Also, weapons are typically filled with explosives from the aft end 340 of the warhead in a vertical position. Finally, the mass is distributed along the entire length of the weapon because it is a structural member and is constructed with sufficient strength to carry the loads from a tail kit, ejector rack, etc. The aerodynamic geometry of the warhead and weapon, in general, is managed through design shape, manufacturing processes and tolerance control.

The center of gravity CG and moment of inertia are most affected by position and design details of the darts 350 within the internal chamber 310 of the warhead. The darts 350 tend to have their center of gravity foreword, which helps with the center of gravity CG of the warhead and weapon. In some cases, it is desirable to stagger the darts 350 longitudinally. The aft end 340 of the warhead is the most desirable place to locate follow-on incendiary and battle damage assessment devices. Since the aforementioned devices are generally lightweight, locating the devices toward the aft end 340 matches well to the moment of inertia characteristic of most warheads and weapons, in general.

Figure 4A:
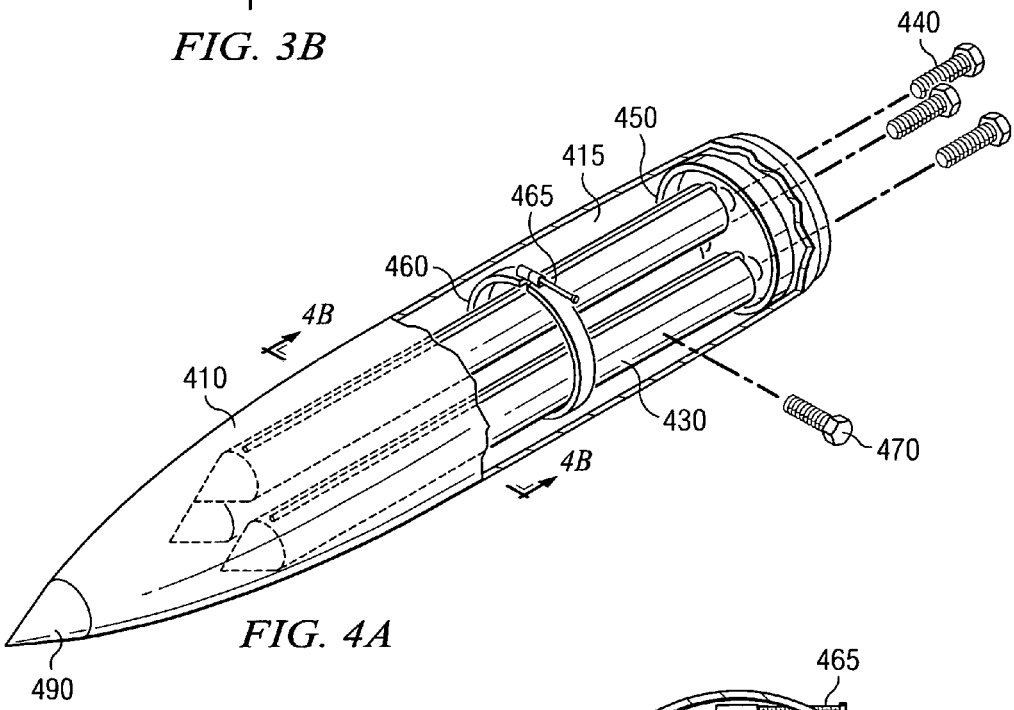
FIGS. 4A and 4B illustrate views of another embodiment of a warhead constructed according to the principles of the present invention.
Figure 4B:
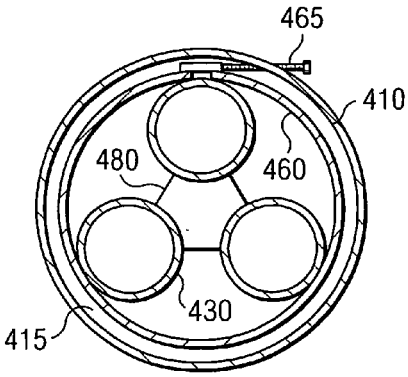

Turning now to FIGS. 4A and 4B, illustrated are views of another embodiment of a warhead constructed according to the principles of the present invention. More specifically, FIG. 4A illustrates a perspective view of the warhead and FIG. 4B illustrates a cross sectional view of the warhead. The warhead includes an outer casing 410 that forms an internal chamber 415 and conforms to a unitary construction in compliance with a well known configuration such as a MK-82. The internal chamber 415 of the warhead includes a plurality of darts (one of which is designated 430), adjustment bolts (one of which is designated 440), a restraining device 450, a restraining clamp 460 with a clamp adjustment bolt 465, a friction adjustment bolt 470 and a pressure saddle 480.

Employing a warhead and weapon in accordance with the present embodiment permits a selection of the weapon yield. A number of configurations can be selected to "dial a yield." Dial a yield is a concept that provides for selecting the yield of a weapon or warhead by various techniques. An example of dial a yield includes a remote selection of the warhead destructive characteristics through various mechanical, electrical, electromechanical devices or other techniques such as hydraulics. For instance, a desired force application against a target may be with a plurality of darts 430 at impact thereby concentrating the full force within a small area. Alternatively, a different effect may be achieved by allowing the darts 430 to dispense separately into the target introducing destructive effects over a larger and more dispersed area.

The warhead of the present embodiment includes a plurality of darts 430 contained within the internal chamber 415 having a geometry akin to presently available configurations. The darts 430 are further secured by the restraining device 450 with adjustments bolts 440, and further restrained by the restraining clamp 460 with the clamp adjustment bolt 465 locking the darts 430 against the pressure saddle 480. For example, the adjustment bolts 440 can be used to restrain a sliding hammer as hereinafter described (albeit defeating a incendiary function thereof) or to couple the base of the darts 430 together to modify the penetration effects.

Additionally, the friction adjustment bolt 470 creates friction on a dart 430 to lessen its penetration effect. Further, the clamp adjustment bolt 465 keeps the darts 430 connected and, with a plurality of pressure saddles 480, the degree of friction for the darts 430 to break free varies and, in addition, the torque of the clamp adjustment bolt 465 may vary. Further, if the pressure saddle 480 is adjusted on a sloping portion of a conical nose of the darts 430, the angle of the darts 430 can be shifted relative to the center line thereby changing the angle of incidence and follow through trajectory at the target after impact. Since there is preferably little or no explosive material in the warhead 410, a fuze well 490 can be employed having a variety of precursor shapes to alter the effects thereof. Additionally, the warhead can contain an incendiary material such as IM-163 or the mechanical impact properties of the warhead can be modified, or any combination of the foregoing to alter the effects thereof.

While not shown in the present embodiment, an opening may be created within the internal chamber 415 of the warhead by employing a cutter charge therein. When the cutter charge detonates, the opening in the internal chamber 415 through the outer casing 410 ensues. The darts 430 may then exit the internal chamber 415 and warhead en route to the intended target to deliver the non-explosive material and create the desired effect. Alternatively, however, the opening in the internal chamber 415 may be created at initial impact with the target inasmuch as the outer casing 410 of the warhead is often formed from softer materials than the darts 430. Thereafter, the darts 430 exit the opening created at initial impact and penetrate the target to create the desired effect.

Figure 5A:
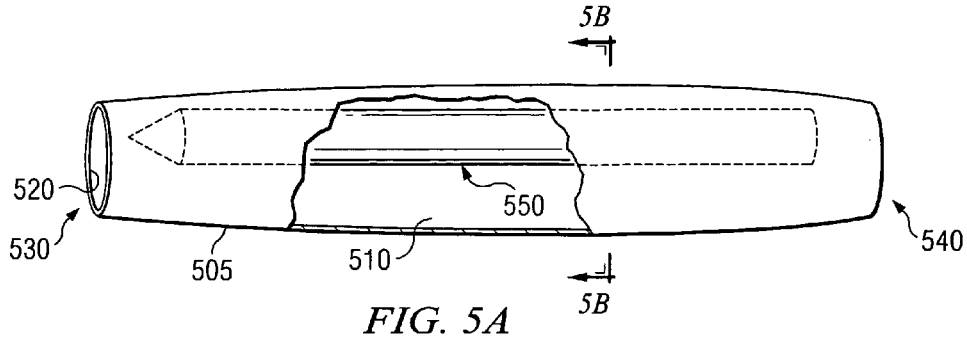
FIGS. 5A, 5B and 5C illustrate views of a yet another embodiment of a warhead and a dart constructed according to the principles of the present invention.
Figure 5B:
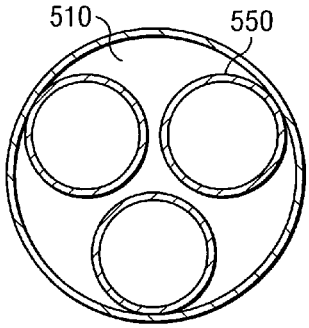
Figure 5C:
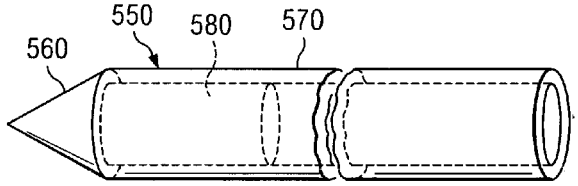

Turning now to FIGS. 5A, 5B and 5C, illustrated are views of yet another embodiment of a warhead and a dart constructed according to the principles of the present invention. More specifically, FIG. 5A illustrates a side view of the warhead, FIG. 5B illustrates a cross sectional view of the warhead and FIG. 5C illustrates a side view of the dart. The warhead includes an outer casing 505 that forms an internal chamber 510 and complies with a well known configuration such as a MK-82. The warhead and the internal chamber 510 have openings (generally designated 520) at a fore end 530 and aft end 540 thereof. The internal chamber 510 of the warhead creates a generally cylindrical volume and contains at least one dart (one of which is illustrated in FIGS. 5A and 5C, and a plurality of which are illustrated in FIG. 5B; generally designated 550). The dart 550 includes a front section (e.g., a conical nose 560) at a fore end thereof, and a main body 570 and a rod 580.

As mentioned above, the warhead emulates a well known configuration referred to as the MK-82. The MK-82 is a free-fall non-guided general purpose weapon having a maximum diameter of approximately 11 inches and having a length of approximately 66 inches that can be carried by a large variety of aircraft. The present embodiment illustrates a warhead using energy combined with mass and materials as a technique for providing a penetration capability, with incendiary and shrapnel effects. The outer casing 505 of the warhead is formed from a steel tube to form a MK-82 warhead with the opening 520 at the fore end 530 of approximately eight inches and the opening (not shown) at the aft end 540 of approximately ten inches. The internal chamber 510 provides the primary containment structure for at least one dart 550.

For the purposes of the illustrative example, the geometric form factor of the warhead accommodates three darts 550 (each having a diameter of approximately 2.5 inches and a length of approximately 60 inches) and the dimensions of the internal chamber 510 having a cylindrical volume is approximately seven inches in diameter and approximately 60 inches in length. The ten inch diameter opening at the aft end 540 of the warhead accommodates the darts 550 with the aforementioned dimensions and permits a degree of control of the weight, the center of gravity, and the moments of inertia of the resulting warhead. While the darts 550 in the illustrated embodiment are of equal size, it is well within the broad scope of the present invention to employ a different number of darts 550 having different sizes and shapes to obtain varying effects at the target upon impact.

The darts 550 include a forward section herein illustrated as having a generally conical nose 560 attached to the main body 570 that is a generally cylindrical tube being hollow through the central portion thereof. While a customary conical nose 560 is shown, other shapes may also be used including, without limitation, a concave or ogive shape to facilitate particular desired effects. Additionally, the main body 570 may also be of different shapes including oval, prismatic, or other general shapes also intended to derive a desired effect. The various shapes are familiar to those skilled in the art, some being derived from the characteristics of the materials that form the generally conical nose 560 and main body 570 of the darts 550.

In the present embodiment, an exemplary function of the darts 550 is as penetrators. The mass, nose shape, length, impact angle of attack and impact velocity of the darts 550 are variables that assist in defining the penetration performance of the darts 550. The aforementioned variables as well as the materials employed further define penetration characteristics of the darts 550. In conjunction therewith, the conical nose 560 employs materials such as an alloy whose primary constituent is tungsten or high strength steel. High strength steel materials are consistent with the structures employed for GBU-28 weapons, a guided bomb unit using a BLU-109 warhead (a large penetrator warhead).

The rod 580 within the main body 570 generally employs materials such as tungsten, although other materials such as spent uranium may also be employed to advantage. The resulting dart 550 employing tungsten, as an example, weighs approximately 100 pounds, and will have more mass per area than the BLU-109, which has a diameter of about 14 inches and weighs about 2,000 pounds and serves as a benchmark for penetrating warheads. The dart 550 according to the principles of the present invention, however, is conditionally stable having a center of mass forward of the center of pressure. Thus, the main body 570 of the dart is formed from a non-explosive material and is noted to be without explosive fill, thereby removing the need for an explosive fuze for detonation and an arming lanyard or similar arming method to arm the warhead and darts 550.

Depending on the techniques by which the warhead is delivered, the darts 550 will exit the opening 520 in the fore end 530 of the internal chamber 510 of the warhead and travel deep inside most targets, having the ability to penetrate armor, concrete, complex structures, and buildings if the impact velocity is in the high subsonic region. While the opening 520 is shown for clarity, in many instances the opening 520 is created at initial impact with a target since the outer casing 505 of the warhead is often formed from a softer material than the darts 550. As mentioned above, a delivery vehicle may be an aircraft, rocket, artillery shell or any similar device generally having the ability to achieve speeds of high subsonic magnitudes and sufficient altitude for affecting the desired mission and at the time of the separation of the weapon therefrom. Of course, other delivery vehicles such as ships are also within the broad scope of the present invention.

Figure 6A:
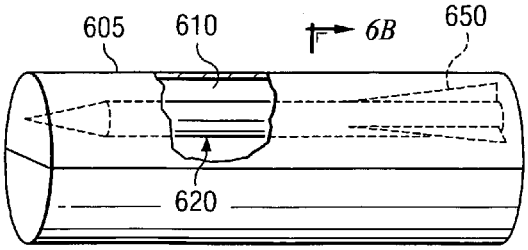
FIGS. 6A, 6B and 6C illustrate views of an embodiment of a submunition and a dart constructed according to the principles of the present invention.
Figure 6B:
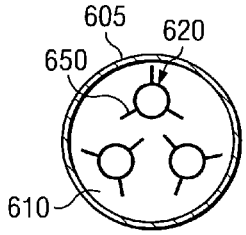
Figure 6C:
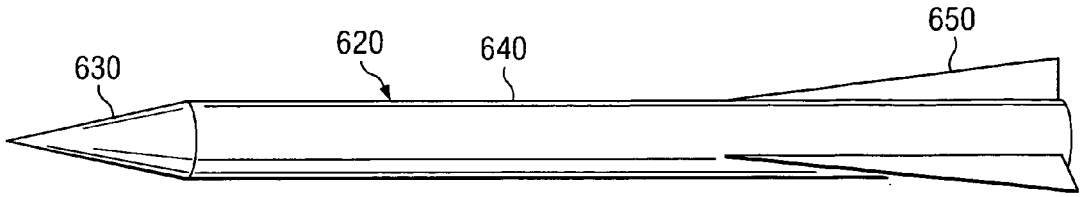

Turning now to FIGS. 6A, 6B and 6C, illustrated are views of an embodiment of a submunition and a dart constructed according to the principles of the present invention. More specifically, FIG. 6A illustrates a side view of the submunition, FIG. 6B illustrates a cross sectional view of the submunition and FIG. 6C illustrates a side view of the dart. As mentioned above, a weapon generally includes a plurality of submunitions within an internal chamber of a warhead of the weapon and the submunitions are configured to exit the internal chamber via an opening therein. The submunition includes an outer casing 605 that forms an internal chamber 610 and complies with a well known configuration such as a BLU-97 combined effects bomblet. The internal chamber 610 of the submunition creates a generally cylindrical volume and contains at least one dart (one of which is illustrated in FIGS. 6A and 6C, and a plurality of which are illustrated in FIG. 6B; generally designated 620). The dart 620 includes a front section (e.g., a generally conical nose 630) at a fore end thereof, a main body 640 and tail fins 650. As mentioned above, the front section may employ a different shape such as a concave or ogive shape and the tail fins 650 may not be present. These variations in design in turn generate different effects to the target upon impact.

The dimensions of the BLU-97 combined effects bomblets are generally 2.3 inches in diameter and approximately eight inches in length. In this case, three tungsten darts 620 (although other high density non-explosive materials are also suitable), each having dimensions less than seven inches long and less than one inch in diameter, are located within the internal chamber 610 of the submunition. As an example, a joint standoff weapon ("JSOW") such as a AGM-154a can accommodate 145 BLU-97 combined effects bomblets with three darts 620 in each submunition thereby providing 435 darts 620. Additionally, the internal chamber 610 may include a plurality of different darts 620 for a submunition complying with the BLU-97 combined effects bomblet. As another example, a standard weapon referred to as a CBU-87 combined effects munitions can accommodate 606 darts 620.

Regarding the dimensions of the darts 620 in the environment of an exemplary embodiment, assuming a deployed diameter of 1.25 inches (within the internal chamber 610), a body diameter of 0.625 inches and a length of 6.66 inches employing a material such as tungsten (other examples include passive zirconium or white phosphorous), the projected frontal area is computed to be approximately 0.06 $in^2$. Assuming further that the main body 640 is five inches in length and the conical nose 630 is 1.66 inches in height, then the dart 620 has a total mass of about one pound (i.e., 0.5 kg). For comparison purposes, a Hydra 70 rocket is fitted with a warhead, designated as the M255A1, which dispenses over one thousand flechettes weighing approximately 0.04 kg each. Thus, the flechettes employed in the M255A1 warhead are much smaller than the darts 620 in this example. The mass/frontal area ratio of the darts 620, which is a measure of penetrating power, is approximately 0.3 kg/cm$^2$, which is about 30 percent of a BLU-109 combined effects bomblet. A high mass to frontal area ratio (i.e., the cross sectional area) indicates a high material stress at the point of impact of the darts 620 into the target. Sufficiently high material stresses induced within the target by the darts 620 leads to adequate penetration of the target.

Further regarding the construction of the darts 620 in comparison to the flechettes as mentioned above, the flechettes are generally fabricated in a configuration having a thin sheet form with the tail fins and body having similar thickness. Upon impact, the aft end of the flechettes tend to collapse toward the nose forming a shape similar to a fish hook. For an example of a flechette, see U.S. Pat. No. 3,545,383 entitled "Fleschette," to Lucy, issued Dec. 8, 1970, and U.S. Pat. No. 4,957,046 entitled "Projectile," to Puttock, issued Sep. 18, 1990, which are incorporated herein by reference. Penetration into a target is compromised as the flechettes rotate and flatten against the target surface. In accordance therewith, to avoid fish hook impacts, the darts 620 according to the principles of the present invention generally employ lightweight tail fins 650 except in those cases wherein a kinetic energy transfer is desired to achieve a particular effect on the target, rather than principally penetration. As illustrated with respect to FIG. 5C, the use of tail fins on the darts is optional, especially when employing proper balance factors in the design thereof. In the present embodiment, the tails fins 650 are generally lightweight and may be fabricated from metal sheets. Of course, any lightweight composite or molded material including plastic may be employed to advantage.

Briefly reviewing other applicable weapon form factors, longer submunitions such as the BLU-108 (an anti-armor munition) have a larger envelope than the BLU-97 combined effects bomblets. The larger envelope such as employed by the BLU-108 may accommodate a plurality of smaller structures therein. The M74 and M77 (both of which are about an inch in diameter) submunitions are two of the most commonly used devices in the military. The M74 and M77 are somewhat smaller than the BLU-97 combined effects bomblets, but the dimensions are more than adequate to effectively employ the features of the present invention. Of course, other form factors may be employed in accordance with the principles of the present invention.

Figure 7A:
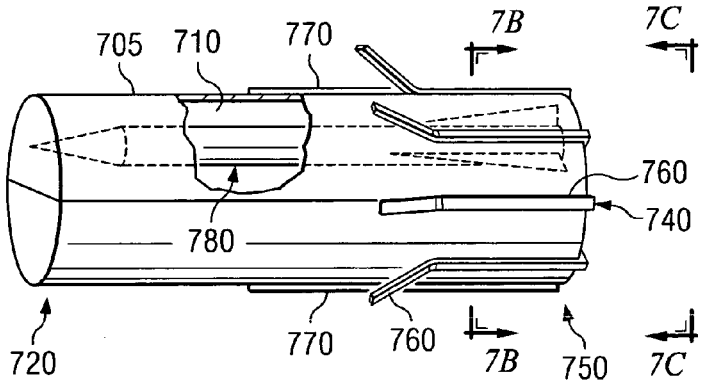
FIGS. 7A, 7B and 7C illustrate views of another embodiment of a submunition constructed according to the principles of the present invention.
Figure 7B:
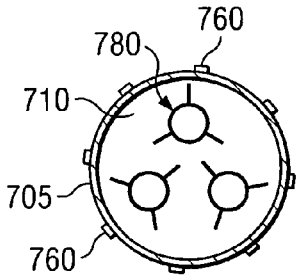
Figure 7C:
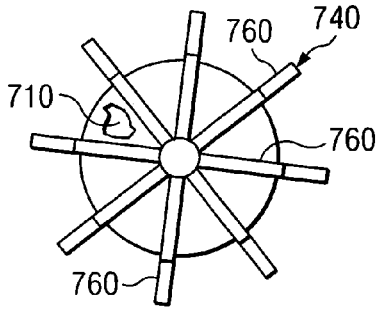

Turning now to FIGS. 7A, 7B and 7C, illustrated are views of another embodiment of a submunition constructed according to the principles of the present invention. More specifically, FIG. 7A illustrates a side view of the submunition, FIG. 7B illustrates a cross sectional view of the submunition and FIG. 7C illustrates an aft end view of the submunition. As mentioned above, a weapon generally includes a plurality of submunitions within an internal chamber of a warhead of the weapon and the submunitions are configured to exit the internal chamber via an opening therein. The submunition includes an outer casing 705 that forms an internal chamber 710 and complies with a well known configuration such as a BLU-97 combined effects bomblet.

The submunition includes a fore end 720 and a spider 740 is located toward an aft end 750 of the submunition. The spider 740 includes legs 760 and the submunition includes fingers 770 extending along an outer casing thereof. The internal chamber 710 of the submunition creates a generally cylindrical volume and contains at least one dart (one of which is illustrated in FIG. 7A, and a plurality of which are illustrated in FIG. 7B; generally designated 780). A direction of flight of the submunition moves from the aft end 750 to the fore end 720 of the submunition.

Typically, a plurality of submunitions are dispensed, scattered, deployed, released or spread out in some manner from openings within an internal chamber of the warhead, usually after the weapon separates from a delivery vehicle. The spider (also referred to as a "spider assembly") 740 is formed from a spring material. The spider 740 is conformal to the cylindrical shape of the submunition until release. Upon the dispense event, the legs 760 of the spider 740 deploy outward to provide an aft movement in the center of pressure and thereby providing a degree of aerodynamic stability. The spider 740 provides pattern control for the submunition as well as providing a consistent condition set for the release of the darts 780.

The fingers 770 extending along the outer casing (e.g., foam) 705 cause a compressive force to bear against the outer casing 705 of the submunition. Assuming that the outer casing 705 is formed or includes separate sections, the number of fingers 770 should be equal to or greater than the number of sections of the outer casing 705. Of course, other techniques such as banding may be employed in addition to or in lieu of the compression fingers 770. While the fingers 770 provide a compressive force within the submunition, when the submunition is released, the fingers 770 serve as drag generators, setting the direction of flight. When the direction of flight stabilizes, the bent fingers 770 generate a sufficient drag and create enough force to separate the spider 740 from the submunition. The outer casing 705 of the submunition then separates and the darts 780 are released to the target. The spring force in the fingers 770 and friction coefficient with the outer casing 705 determines when the spider 740 separates. If the fingers 770 are not the same length, the submunition will "corkscrew" (i.e., begin rotating) providing another technique for dispersion. If the submunition is released so that the initial direction of flight is spider forward, the submunition will tumble, eventually attaining stable configuration, thus providing a further technique of dispersion control.

In instances when the fingers 770 are not employed with the submunition, it is possible to create an opening therein for releasing the darts 780 at the initial impact with a target. Under these circumstances, the outer casing 705 of the submunition is typically formed in a single section and with a softer material than the darts 780. The darts 780 then penetrate the target as described herein.

Figure 8A:
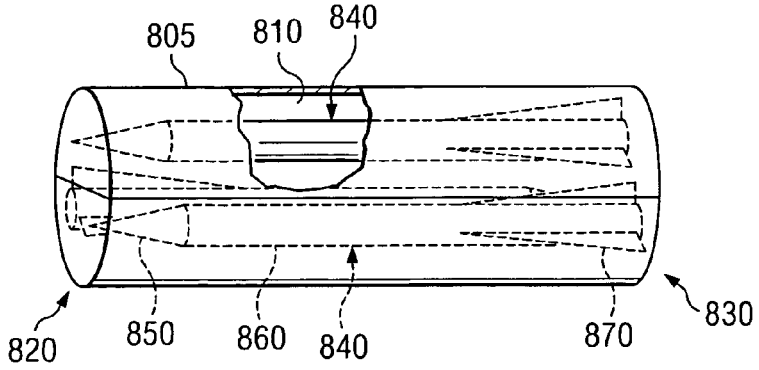
FIGS. 8A, 8B, 8C and 8D illustrate views of yet another embodiment of a submunition and a dart constructed according to the principles of the present invention.
Figure 8B:
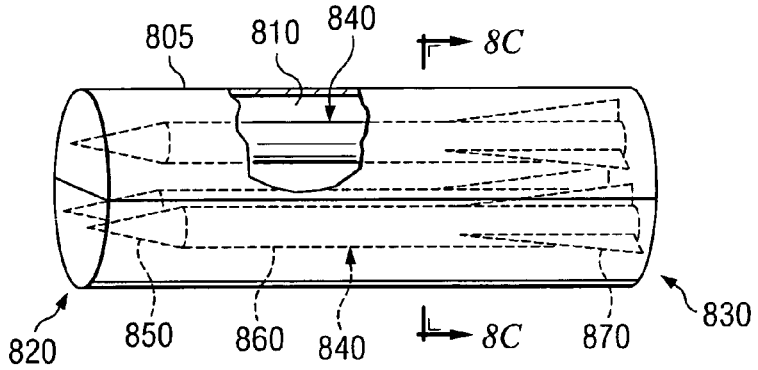
Figure 8C:
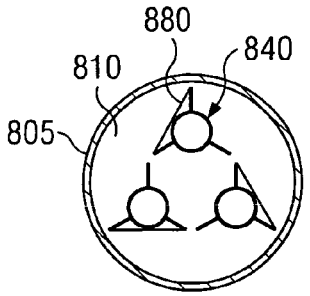
Figure 8D:
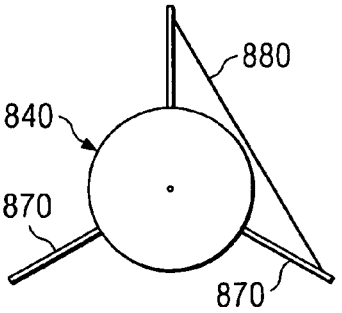

Turning now to FIGS. 8A, 8B, 8C and 8D, illustrated are views of yet another embodiment of a submunition and a dart constructed according to the principles of the present invention. More specifically, FIGS. 8A and 8B illustrate side views of the submunition, FIG. 8C illustrates a cross sectional view of the submunition and FIG. 8D illustrates an end view of the dart. As mentioned above, a weapon generally includes a plurality of submunitions within an internal chamber of a warhead of the weapon and the submunitions are configured to exit the internal chamber via an opening therein. The submunition includes an outer casing 805 that forms an internal chamber 810 and complies with a well known configuration such as a BLU-97 combined effects bomblet. A direction of flight of the submunition moves from the aft end 830 to the fore end 820 of the submunition.

The internal chamber 810 of the submunition creates a generally cylindrical volume and contains a plurality of darts 840. As demonstrated by FIGS. 8A and 8B, it is well within the broad scope of the present invention to orient the darts 840 differently such that one or more of the darts 840 are facing different directions within the internal chamber 810 of the submunition. The darts 840 oriented differently generally follow dissimilar trajectories since the darts 840 oriented in an opposite orientation to the direction of flight will tumble until a stable flight configuration is achieved. In addition to the front section 850, main body 860 and tail fins 870, the darts in the present embodiment include a wedge 880 (see FIGS. 8C and 8D) at an aft end thereof.

The darts 840 in the submunitions will maneuver away from each other until the wedges 880 separate (see FIG. 8C). The wedge 880 is web attached to the aft surfaces of two adjacent tail fins 870. In one embodiment, the wedge 880 is located on a trailing edge between two adjacent tail fins 870 such that placement and retention is achieved by a physical interference fit that creates friction between the wedge 880 and the tail fins 870. Alternatively, clips, indentations or other mechanical features may be employed to attach the wedge 880 to the tail fins 870, albeit temporary. When the darts 840 emerge from the submunition and are released into the air stream, the wedge 880 separates from the tail fins 870. Aerodynamic and inertial forces act on the wedge 880 resulting in a separation from the dart 840. Before separation, the wedge 880 imparts a drag force and yaw moment that causes the darts 840 to take divergent trajectories. This feature may be employed for any number of surfaces for the tail fins 870. In addition to the aforementioned design features, the submunitions can be configured with different fore and aft combinations, and with different spiders as described above. Without the spiders, however, the submunitions avoid aero-retarders and thus preserve kinetic energy.

The wedge 880 may be formed from a web of plastic film stretched between the tail fins 870, since the resulting function is to provide a brief yaw moment for dispersion. Of course, other configurations adapted to impart the drag force such as a partial web, rather than one that fills the entire space between the tail fins 870, a solid wedge 880 placed between the tail fins 870, and a wedge 880 with holes are well within the broad scope of the present invention. It is also possible and may be advantageous (possibly for pattern control) to provide wedges 880 on ones of the darts 840 within the submunitions. When used with sufficiently large darts 840, it is practical to employ electromagnetic, mechanical, pyrotechnic devices or other active control of wedge 880 separation or articulation, so as to control the period of trajectory influence.

The aforementioned example illustrates the ways in which darts can be placed within the submunition and ways in which the darts can be dispensed therefrom. Those skilled in the art understand that other techniques may be employed and still be within the broad scope of the present invention.

Figure 9A:
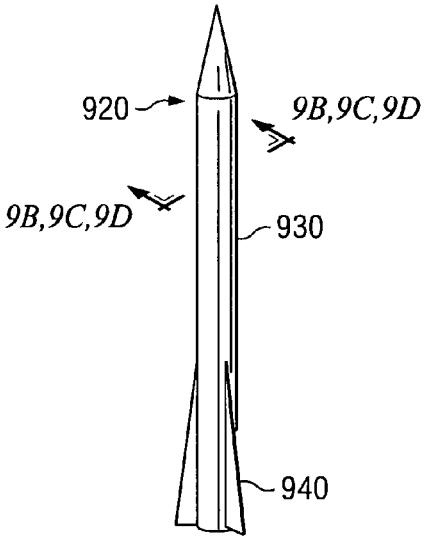
FIGS. 9A, 9B, 9C and 9D illustrate views of an embodiment of a dart constructed according to the principles of the present invention.
Figure 9B:
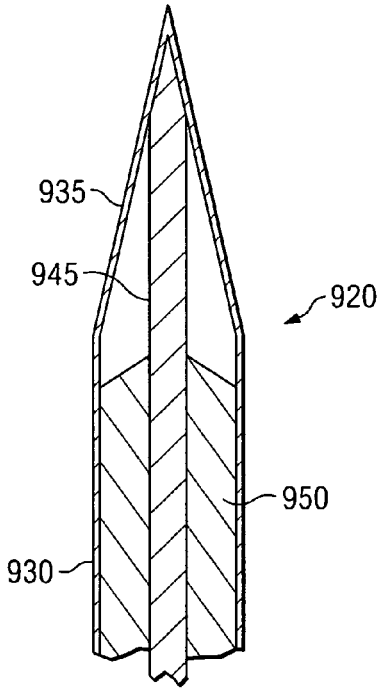
Figure 9C:
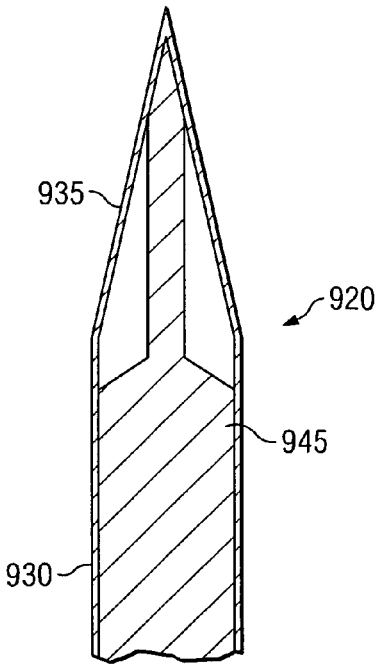
Figure 9D:
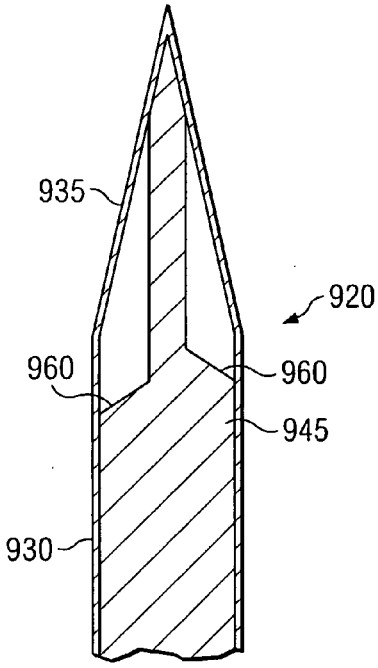

Turning now to FIGS. 9A, 9B, 9C and 9D, illustrated are views of an embodiment of a dart constructed according to the principles of the present invention. More specifically, FIG. 9A illustrates a side view of a dart whereas FIGS. 9B to 9D illustrate cross sectional views of a portion of the dart. As illustrated in FIG. 9A, the dart includes a forward section 920, a main body 930 and tail fins 940. The cross sectional views of a portion of the dart illustrated in FIGS. 9B, 9C and 9D principally depict the forward section 920 and main body 930 of the dart demonstrating different exemplary designs thereof.

The principles of the present invention as disclosed in the present embodiment include the creation of combined effects with an external application of a metal or plurality of metals to a dart. It is important to note that the desired effects are achieved without the use of sensitive explosive materials. The non-explosive materials applied herein are substantially inert in environments that are normal and under benign conditions. Stressing environments as discussed herein are generally insufficient to cause the selected materials (e.g., tungsten, hardened steel, zirconium, copper, depleted uranium and other like materials) to become destructive in an explosive or incendiary manner. The latent lethal explosive factor is minimal or non-existent. Reactive conditions are predicated on the application of high kinetic energy transfer, a predominantly physical reaction and not on explosive effects, a predominantly chemical reaction.

The designs employed herein disclose a combined effects dart formed from various materials of suitable characteristics (i.e., non-explosive materials) and of selected geometric shapes. The proportions depicted herein are exaggerated for purposes of clarity and illustration. In the illustrated embodiments, the forward sections 920 include a generally conical zirconium (or similar material) section 935 with a central tungsten core (or other acceptable material) 945. The proportions of tungsten and zirconium are balanced to produce the desired penetration and incendiary effects. At impact, the dart has sufficient kinetic energy to penetrate a target. The transfer from kinetic energy to heat energy through impact mechanics increases the temperature of the zirconium above its ignition point. When applied to the target, spalling or burning incendiary material (in this case zirconium) fragments scatter across the target to create ignition points and fires. Fragments of tungsten rebound throughout the target creating shrapnel damage. Those skilled in the art will realize that the proportions of tungsten and zirconium can be varied to produce different results. Additionally, darts of different material proportions can be encapsulated into a submunition to produce a wide range of effects.

Additionally, as illustrated in FIG. 9B, the dart may also include an outer body 950 formed from materials such as copper, lead or other suitable material. Under high energy impact conditions, the materials employed for the outer body 950 become liquid (molten) providing a lubricating medium between the target and the dart. The materials that form the dart and the target will spall off being propelled by kinetic energy and other mechanical spring forces, creating damage due to secondary impact. Additionally, the outer body 950 may be formed from a plurality of materials such as steel, zirconium, aluminum, and copper. By using alternating bands, a plurality of effects can be achieved such as pyrophoric, fragmentary, and other effects. In addition, the longitudinal placement of the plurality of materials can be selected in such a way as to effect the center of gravity and moments of inertia to better control factors such as aerodynamic characteristics, penetration characteristics, incendiary characteristics, and other characteristics.

Thus, combining different and multiple materials within a weapon can enhance certain characteristics thereof. For a better understanding of exemplary weapons employing different materials therein, see U.S. Pat. No. 5,413,048 entitled "Shaped Charge Liner including Bismuth," to Werner, et al., issued May 9, 1995, U.S. Pat. No. 5,567,906 entitled "Tungsten Enhanced Liner for a Shaped Charge," to Reese, et al., issued Oct. 22, 1996, U.S. Pat. No. 5,728,968 entitled "Armor Penetrating Projectile," to Buzzett, et al., issued Mar. 17, 1998, and U.S. Pat. No. 6,174,494 entitled "Non-lead, Environmentally Safe Projectiles and Explosives Containers," to Lowden, et al., issued Jan. 16, 2001, which are incorporated herein by reference.

The type and location of materials within the dart can also enhance the degree of penetration and to produce other effects such as tumbling thereafter these events. Geometric characteristics such as asymmetric shaping (see asymmetrical feature 960 in the conical zirconium section 935 illustrated in FIG. 9D) and an off center central core will enhance a wide variation of reactions and response of the dart within the target. Break-away tail fins 940 and other built in responses to impact and collision will induce other response characteristics such as lateral secondary impact.

Figure 10A:
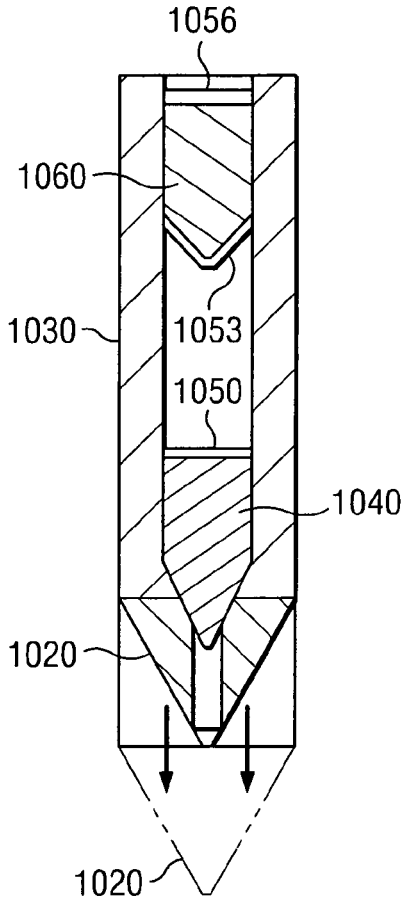
FIGS. 10A, 10B and 10C illustrate views of another embodiment of a dart constructed according to the principles of the present invention.
Figure 10B:
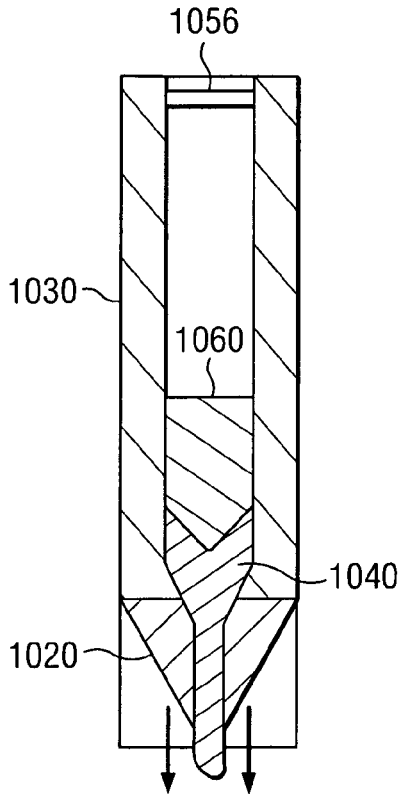
Figure 10C:
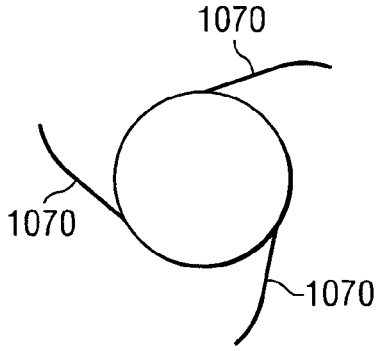

Turning now to FIGS. 10A, 10B and 10C, illustrated are views of another embodiment of a dart constructed according to the principles of the present invention. More specifically, FIGS. 10A and 10B illustrate cross sectional views of a dart in various stages, namely, post-deployed, pre-impact and post-deployed, post-impact, respectively, and FIG. 10C illustrates an end view of the dart. The dart may be employed with or as a submunition that complies with a well known configuration such as a BLU-97 combined effects bomblet. The dart includes an extendable forward section (e.g., a windscreen of generally conical shape) 1020, a main body 1030 having incendiary material 1040, restraining devices (e.g., first, second and third restraining devices 1050, 1053, 1056) and a hammer 1060 and tail fins 1070.

The windscreen 1020 in combination with the tail fins 1070 (which may of may not be deployable) provide aerodynamic effects such as stability and a low drag feature. Upon impact, the hammer (e.g., a sliding weight) 1060 breaks the second restraining device 1053 and slides forward, applying (e.g., injecting) the incendiary material 1040 by plastic flow to the target (see FIG. 10B). The first restraining device 1050 holds the incendiary material 1040 in place prior to release of the hammer 1060 and then is designed to allow the hammer 1060 break therethrough to incendiary material 1040. The third restraining device 1056 prevents the hammer 1060 from exiting the dart via the aft end. The restraining devices 1050, 1053, 1056 will generally be of different shape, thickness and material to accomplish necessary variations of restraint. Again, the dart preferably employs non-explosive materials therein. Analogous to the other embodiments disclosed herein, the materials and configuration of the dart may be modified to accommodate a particular application.

Figure 11A:
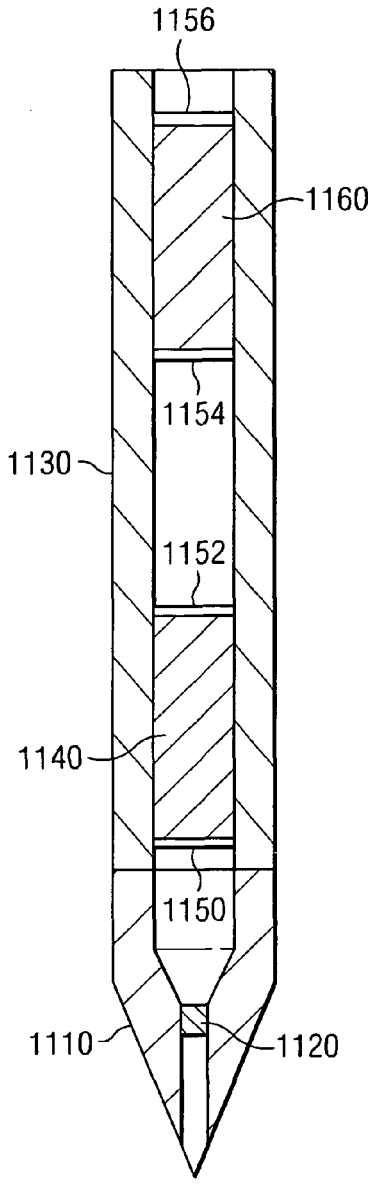
FIGS. 11A and 11B illustrate views of yet another embodiment of a dart constructed according to the principles of the present invention.
Figure 11B:
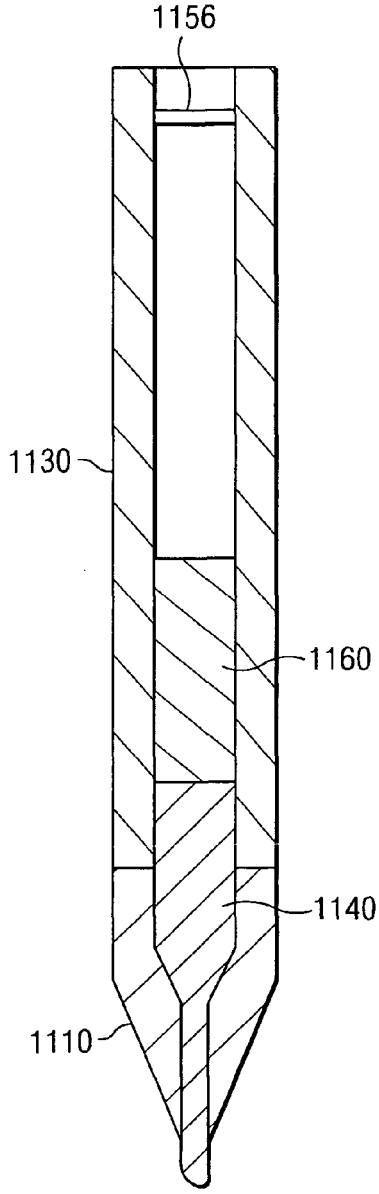

Turning now to FIGS. 11A and 11B, illustrated are views of yet another embodiment of a dart constructed according to the principles of the present invention. More specifically, FIGS. 11A and 11B illustrate cross sectional views of a dart in various stages, namely, post-deployed, pre-impact and post-deployed, post-impact, respectively. The dart includes a forward section 1110 with a first incendiary material 1120 and a main body 1130 including a second incendiary material (e.g., zirconium) 1140, restraining devices (e.g., formed from copper or soft alloy and embodied in first, second, third and fourth restraining devices 1150, 1152, 1154, 1156) and a hammer (e.g., tungsten) 1160.

The hammer 1160 controls the introduction or application of the first and second incendiary materials 1120, 1140 into the target. The restraining devices (and most notably the first and third restraining devices 1150, 1154) enhance the transfer of kinetic energy to the second incendiary material 1140. Again, the restraining devices 1150, 1152, 1154, 1156 are typically of different shape, thickness and material to accomplish necessary variations of restraint. The desired effect is to convert the kinetic energy of the hammer (e.g., a sliding weight) 1160 into heat and plastic distortion of the second incendiary material 1140. The addition of a soft material associated with the second and fourth restraining devices 1152, 1154 helps to avoid shattering the hammer 1160 and the second incendiary material 1140. The second restraining device 1152 also helps to avoid the hammer 1160 acting as a wedge thereby exerting a force perpendicular to the desired direction of material movement. A soft material such as copper can also be applied with benefit to portions of the hammer 1160 with a tapered or conical leading edge such as illustrated with respect to FIGS. 10A to 10C.

The first incendiary material 1120 aids in the ignition of the second incendiary material 1140 embodied in a pyrophoric material such as zirconium. Of course, other configurations may be employed to add an incendiary material to the forward section 1110 such as coating the funnel and throat of the nose cone thereof. As described with respect to FIGS. 9A to 9D, the dart may employ alternating bands of incendiary material in a "C" or "O" type configuration within the forward section 1110 or the main body 1130 in conjunction with a denser penetrating material. The aforementioned variations represent configurations to vary a degree of incendiary effect and the types of target interactions that will further trigger the incendiary effect. Again, the dart preferably employs non-explosive materials therein.

An important problem, not addressed by conventional weapons, is the need to vary yield. To those skilled in the art, the term "yield" conveys the concept of both the type of weapon effect and the magnitude of the effect. While some sophisticated fuze systems can provide delays in function, the nature of high explosives is that when a detonation occurs, its magnitude is invariant. The use of kinetic energy provides a number of methodologies to vary yield to a degree not possible with conventional weapons. For example, the incendiary material could be removed to lessen the incendiary effects on some targets and thus achieve options not readily available with existing weapons.

Figure 12A:
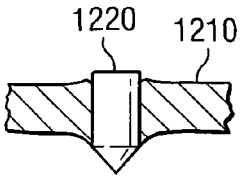
FIGS. 12A, 12B and 12C illustrate views demonstrating effects of employing a dart constructed according to the principles of the present invention.
Figure 12B:
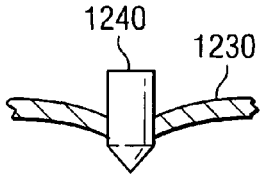
Figure 12C:
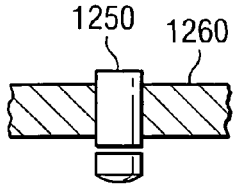

Turning now to FIGS. 12A, 12B and 12C, illustrated are views demonstrating effects of employing a dart constructed according to the principles of the present invention. More specifically, FIG. 12A illustrates the general condition of a thick target 1210 penetrated by a pointed dart (i.e., a dart with a pointed front section) 1220. FIG. 12B illustrates the general condition of a thin target 1230 penetrated by a pointed dart 1240. FIG. 12C illustrates the general condition of a blunt dart (i.e., a dart with a blunt front section) 1250 penetrating a target 1260.

In the aforementioned penetration effects and generally speaking, considerable plasticity is exhibited by the target material. The kinetic energy of a dart which is used to pierce a target is equal to the work done in expanding the hole from zero to the dart diameter. Thus, the work done in creating plastic flow is a significant use of the impact kinetic energy to pierce an armor plate or other target. Therefore, within the target, the internal frictional forces of the plastic flow create significant heat at the point of impact. The heat, along with the frictional forces at the interface between the sides of the dart and the target material, provide powerful mechanism to ignite zirconium or other suitable non-explosive material from the dart and to provide a configuration for the separation for these materials. Even if the target material later shatters, most materials will exhibit this plastic behavior long enough to support this effect. These same effects will liquefy materials such as copper. The ignited or molten materials will take two principle courses. The materials will travel into the target, most of the remaining materials will rebound from spring forces at the exterior impact site and be distributed outside the target by those spring forces. The liquefied material at the interface provides a mechanism to lubricate the dart, improving the penetration over the effects of a simple hard material dart.

In accordance therewith, many non-explosive materials may be employed and while metals are the most obvious, other materials can be selected for a variety of purposes. For example, a hard plastic material also provides a source of incendiary effect. Zirconium has been shown as the pyrophoric or incendiary material of choice, but this is only one of many potential alternatives and other materials may be preferable based on the application. The use of IM-162 (a standard incendiary composition) or other incendiary material with an oxidizer can be incorporated as well, if the anticipated kinetic environment does not provide enough energy for reliable ignition.

For a better understanding of exemplary weapons employing features and selected materials to attain general penetration effects and the like, see "A Comparison of the Advantages and Disadvantages of Depleted Uranium and Tungsten Alloy as Penetrator Materials," Tank Ammo Section Report No. 107 (June 1980), U.S. Pat. No. 4,648,324 entitled "Projectile with Enhanced Target Penetrating Power," to McDermott, issued Mar. 10, 1987, U.S. Pat. No. 4,803,928 entitled "Tandem Charge Projectile," to Kramer, et al., issued Feb. 14, 1989, U.S. Pat. No. 5,561,261 entitled "Tandem Warhead with a Secondary Projectile," to Lindstadt, et al., issued Oct. 1, 1996, U.S. Pat. No. 5,834,684 entitled "Penetrator having Multiple Impact Segments," to Taylor, issued Nov. 10, 1998, U.S. Pat. No. 5,988,071 entitled "Penetrator having Multiple Impact Segments, including an Explosive Segment," to Taylor, issued Nov. 23, 1999, U.S. Pat. No. 6,021,716 entitled "Penetrator having Multiple Impact Segments," to Taylor, issued Feb. 8, 2000, U.S. Pat. No. 6,105,505 entitled "Hard Target Incendiary Projectile," to Jones, issued Aug. 22, 2000, U.S. Pat. No. 6,374,744 entitled "Shrouded Bomb," to Schmacker, et al., issued Apr. 23, 2002, and U.S. Pat. No. 6,389,977 entitled "Shrouded Aerial Bomb," to Schmacker, et al., issued May 21, 2002, which are incorporated herein by reference.

Alternatively, in those cases where a class of weapons is elicited containing a significant amount of energetic, explosive material, it would be advantageous to construct the weapons in such a way as to facilitate their location. The techniques used to facilitate identification and location of the weapons should be consistent with the practices and equipment of those who conduct these operations, and who have the skill necessary to disable unexploded ordnance in the safest manner possible. In any event, it is desirable to enhance the mission planning and battle damage assessment in such a way as to improve the probability of achieving the desired effect, to reduce the probability of collateral damage and unexploded ordnance, and to achieve post mission assessments that avoid unnecessary follow on attacks.

Figure 13A:
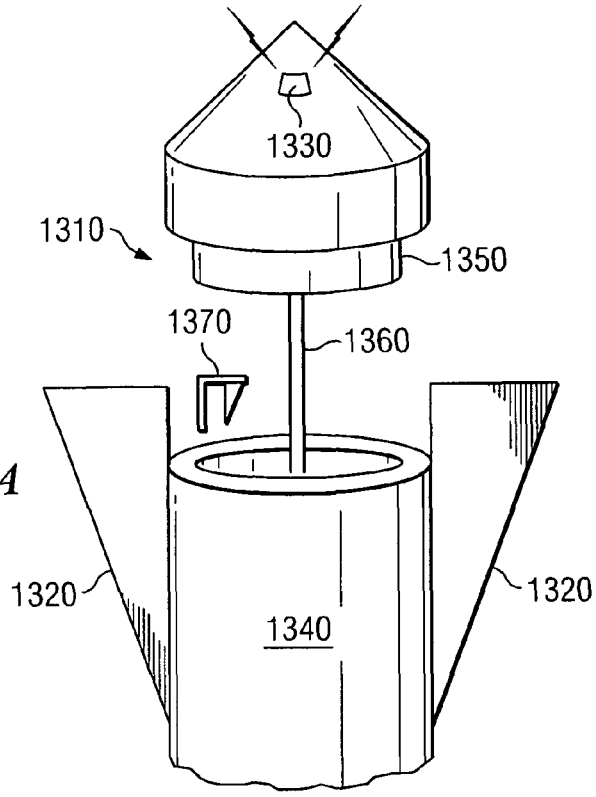
FIGS. 13A, 13B and 13C illustrate views of an embodiment of a submunition constructed according to the principles of the present invention.
Figure 13B:
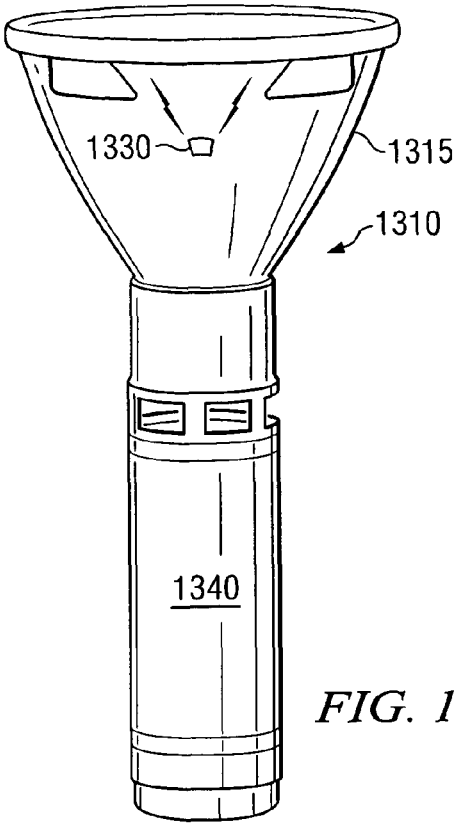
Figure 13C:
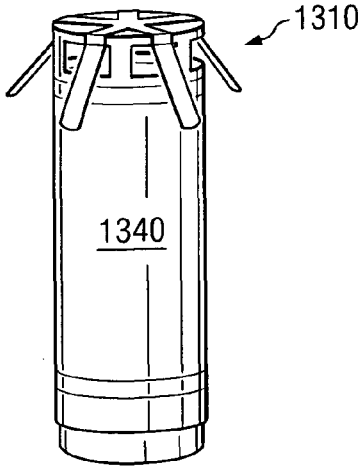

Turning now to FIGS. 13A, 13B and 13C, illustrated are views of an embodiment of a submunition constructed according to the principles of the present invention. More specifically, FIGS. 13A and 13B illustrate a side view of the submunition, or portions thereof, following a deployment of a drag mechanism, and FIG. 13C illustrates a side view of the submunition before a deployment of a drag mechanism. The submunition of the present embodiment addresses the issue of identifying a location thereof, especially when explosive materials are employed in the submunition.

The submunition includes a tail cone assembly 1310 including tail fins 1320 for aerodynamic stability. The tail cone assembly 1310 also includes a drag mechanism 1315 when deployed, for instance, from free flight. The tail cone assembly 1310 is fitted with a radio frequency identification ("RFID") tag 1330. The RFID tag 1330 may have a unique identification (including, for instance, information about the source of the submunition) and use encryption in response to a reader employed to identify the RFID tag 1330. The tail cone assembly 1310 is pressed to fit, or otherwise attached to, a main body 1340 with an internal chamber being a hollow body structure. Alternatively, the main body 1340 may be solid or jacketed, with an aft end void, rather than being hollow and tubular for its entire length. In FIG. 13A, a stepped down section 1350 of the tail cone assembly 1310 facilitates a pressed fit into the aft end of the main body 1340. A plunger rod 1360, if incorporated, removes contents (such as dye powder packs or incendiary materials) of the internal chamber of the main body 1340 when impact strips away the tail cone assembly 1310. A ripper assembly 1370 may be incorporated and attached to the main body 1340 such that the differential movement of the contents of the void, when separated by the plunger rod 1360, or by base drag effects caused by the separation of the tail cone assembly 1310, will cause the ripper assembly 1370 to cut open any sealed packages of dye powder, incendiary materials, or other payload materials.

The drag mechanism 1315 typically takes the form of, without limitation, a streamer or ballute. The drag mechanism 1315 is stowed in a different configuration in the carriage state (see FIG. 13C) as opposed to the free flight state (see FIG. 13B). The drag mechanism 1315 is typically made of nylon or some other light fabric, plastic, or similar material and, as such, provides a favorable dielectric substrate for a location of the RFID tag 1330.

Additionally, in conjunction with identifying the RFID tag 1330, it is often necessary to have the capability to identify many RFID tags 1330 in close proximity to one another and under poor signal conditions. Thus, employing a reader that can decipher the RFID tag 1330 in the midst of interference is contemplated in accordance with identifying the same. In addition to identifying the submunition as described above, a reader that incorporates metal detection may also be employed for detecting land mines (see, as an example, U.S. patent application Ser. No. 10/378,043, now U.S. Pat. No. 7,019,650, entitled "Interrogator and Interrogation System Employing the Same," to Volpi, et al., issued Mar. 28, 2006, which is incorporated herein by reference). To provide the energy necessary to read the RFID tags 1330, it is possible to employ the energy available from ground penetrating radars or the like.

Thus, the principles of the present invention also contemplate a system for providing additional weapons effects and system for marking a location of weapon impacts for conventional explosive munitions, which are prone to being a source of unexploded ordnance. Accordingly, it is very advantageous to locate the submunition or weapon, in general, employing the RFID tag 1330 for the class of kinetic weapons described herein, and for conventional explosive weapons whose mission effectiveness may be improved by marking impact locations.

In accordance therewith, mission planning methods and processes may be used to employ the benefits of the present invention including weapons effects, avoiding collateral damage, yield selection, and processes for post mission assessments. By adding a database (and algorithms to use the database) containing factors such as weapons effects verses target type (e.g., for each weapon/target combination), predictions of collateral damage radius verses target type and collateral context, and marker information per weapon, the time needed to execute the orient, decide, and act portions of strike weapon planning can be greatly reduced.

The near zero collateral damage greatly reduces the complexity of compliance with orders to avoid critical friendly zones or other sensitive areas. The analysis and synthesis needed to employ weapons without fuze settings, complex safety processes, and with reduced storage and safety concerns allows a planner more options in the rule-based mission planning process. Mission planning algorithms can be used to plan the kinematic energy at impact thereby creating a "variable yield" weapon system. New information is less likely to require re-planning. These factors and the simplicity of the new database greatly increase the speed of the decision processes involved in planning.

Finally, the actions taken are stored in an archival database, so that post mission assessments can utilize the records of, without limitation, weapons choices, yield management selections, trajectory selection, marker and RFID data, and other data useful for the purpose of assisting in post strike assessments, or the observe and orient portions of post strike assessments. By using the database (and algorithms to use the database) containing planned actions taken including target, target location, marker and RFID data, predicted weapons effects verses target type, predictions of collateral damage radius, methods of compliance with orders to avoid critical friendly zones or other sensitive areas, post strike assessors can determine which observations to use to assess the outcome of the attack. For example, if visible dye powder was released, imagery indicating such a marker is a highly credible indicator that the weapon impacted properly and in the desired location. By archiving the predicted weapons effects, the post strike analysis is greatly improved, as compared to situations wherein the analyst does not have that information and is left to ponder a hole in a roof. Similarly, with a record of the yield settings and trajectory selection for yield management, the analyst is greatly assisted in understanding the likelihood that the desired effect was achieved. The observe-orient-decide-act framework is adapted from "The Essence of Winning and Losing," by John R. Boyd (January 1996), which is incorporated herein by reference.

Thus, a weapon with a warhead that employs a transfer of kinetic energy into an intended target for purposes of selective destruction with readily attainable and quantifiable advantages has been introduced. The warhead contains little or no explosive materials and fragments into lethal shrapnel and incendiary debris from kinetic energy transfer at impact. The fragments and debris have little or no lethal or incendiary effect when in a benign state. Additionally, the incorporation of the principles of the present invention into an arsenal increases a yield of the arsenal by reducing the number of different weapons therein. Further advantages are achieved when the weapon and accompanying warhead are so arranged as to conform to the mass properties, specifications, and geometry of existing and qualified weapon configurations.

The weapon system of the present invention draws on the advantages of precision guidance and employs kinetic energy to achieve the desired effects. Debris from such a weapon is inert in benign and normal environments within seconds after the event thereby reducing clean up efforts associated with the deployment thereof. Likewise, a weapon according to the principles of the present invention may closely conform to existing payload specifications, which are important to the qualification process, of existing qualified weapons thereby reducing the cost for qualification and acceptance into the arsenal.

Additionally, exemplary embodiments of the present invention have been illustrated with reference to specific components. Those skilled in the art are aware, however, that components may be substituted (not necessarily with components of the same type) to create desired conditions or accomplish desired results. For instance, multiple components may be substituted for a single component and vice-versa. The principles of the present invention may be applied to a wide variety of weapon systems.

Although the present invention has been described in detail, those skilled in the art should understand that they can make various changes, substitutions and alterations herein without departing from the spirit and scope of the invention in its broadest form.

What is claimed is:

1. A weapon, comprising:

a warhead having an outer casing that forms an internal chamber;

a dart within said internal chamber and configured to exit said internal chamber via an opening therein, said dart being directly secured to an aft end of said warhead with a restraining device about an aft end of said dart and further restrained within said warhead with a restraining clamp about an outer side of said dart against a pressure saddle on an inner side of said dart.

2. The weapon as recited in claim 1 wherein said restraining clamp and said pressure saddle are located on a central portion of said dart.

3. The weapon as recited in claim 1 wherein said dart comprises a conical nose and said pressure saddle is located on a sloping inner side of said conical nose.

4. The weapon as recited in claim 1 further comprising a friction adjustment bolt configured to create friction on said dart.

5. The weapon as recited in claim 1 further comprising a clamp adjustment bolt configured to lock said restraining clamp about said outer side of said dart against said pressure saddle on said inner side of said dart.

6. The weapon as recited in claim 1 further comprising a plurality of darts within said internal chamber and configured to exit said internal chamber via said opening therein, said plurality of darts being secured to said aft end of said warhead with said restraining device about an aft end said plurality of darts and further restrained within said warhead with said restraining clamp about an outer side of said plurality of darts against said pressure saddle on in inner side of said plurality of darts.

7. The weapon as recited in claim 6 wherein ones of said plurality of darts are a different size.

8. The weapon as recited in claim 1 wherein said warhead includes a fore end, said dart being configured to exit said internal chamber via said opening in said fore end.

9. The weapon as recited in claim 1 further comprising a fuze well.

10. The weapon as recited in claim 1 wherein said dart is formed with a non-explosive material.

11. A weapon system, comprising:

a delivery vehicle;

a weapon, including:

a warhead having an outer casing that forms an internal chamber; and a dart within said internal chamber and configured to exit said internal chamber via an opening therein, said dart being directly secured to an aft end of said warhead with a restraining device about an aft end of said dart and further restrained within said warhead with a restraining clamp about an outer side of said dart against a pressure saddle on an inner side of said dart; and a guidance system configured to direct said weapon to a target.

12. A weapon system as recited in claim 11 wherein said restraining clamp and said pressure saddle are located on a central portion of said dart.

13. The weapon system as recited in claim 11 wherein said dart comprises a conical nose and said pressure saddle is located on a sloping inner side of said conical nose.

14. The weapon system as recited in claim 11 wherein said weapon further includes a friction adjustment bolt configured to create friction on said dart.

15. The weapon system as recited in claim 11 wherein said weapon further includes a clamp adjustment bolt configured to lock said restraining clamp about said outer side of said dart against said pressure saddle on said inner side of said dart.

16. The weapon system as recited in claim 11 wherein said weapon further includes a plurality of darts within said internal chamber and configured to exit said internal chamber via said opening therein, said plurality of darts being secured to aft said end of said warhead with said restraining device about an aft end of said plurality of darts and further restrained within said warhead with said restraining clamp about an outer side of said plurality of darts against said pressure saddle on in inner side of said plurality of darts.

17. The weapon system as recited in claim 16 wherein ones of said plurality of darts are a different size.

18. The weapon system as recited in claim 11 wherein said warhead includes a fore end, said dart being configured to exit said internal chamber via said opening in said fore end.

19. The weapon system as recited in claim 11 further comprising a fuze well.

20. The weapon system as recited in claim 11 wherein said dart is formed with a non-explosive material.

* * * * *